United States Patent [19]

Anbe

[11] 4,087,859

[45] May 2, 1978

[54] APPARATUS FOR MEASURING AND CONTROLLING INTERSTAND TENSIONS OF CONTINUOUS ROLLING MILLS

[75] Inventor: Yoshiharu Anbe, Fuchu, Japan

[73] Assignee: Tokyo Shibaura Denki Kabushiki Kaisha, Kawasaki, Japan

[21] Appl. No.: 714,667

[22] Filed: Aug. 16, 1976

[30] Foreign Application Priority Data

Aug. 20, 1975 Japan ..... 50/100947

[51] Int. Cl.[2] ..... B21B 37/00; G06F 15/46

[52] U.S. Cl. ..... 364/472; 72/8

[58] Field of Search ..... 235/151.1, 151.11; 72/7, 8, 9, 11, 12, 19, 21, 28

[56] References Cited

U.S. PATENT DOCUMENTS

| | | | |
|---|---|---|---|
| Re. 26,996 | 12/1970 | Beadle et al. | 72/7 |
| 3,507,134 | 4/1970 | Silva | 72/8 |
| 3,592,031 | 7/1971 | Sutton et al. | 72/8 |
| 3,768,286 | 10/1973 | Peterson | 72/9 |
| 3,787,667 | 1/1974 | King et al. | 235/151.1 |

*Primary Examiner*—Joseph F. Ruggiero
*Attorney, Agent, or Firm*—Stevens, Davis, Miller & Mosher

[57] ABSTRACT

There are provided operation apparatus and presetting apparatus for presetting a rolling program into the operation apparatus. In response to the preset value the operation apparatus computes the forward tension stress coefficient $\gamma$ and the rearward tension stress coefficient $\delta$ in accordance with the following equation $$\gamma = \delta = (A \cdot V/\omega) \cdot K$$

where $\omega$ represents the angular speed of the roll, K a unit conversion constant, and A·V mass flow.

5 Claims, 2 Drawing Figures

APPARATUS FOR MEASURING AND CONTROLLING INTERSTAND TENSIONS OF CONTINUOUS ROLLING MILLS

BACKGROUND OF THE INVENTIONL

This invention relates to apparatus for measuring and controlling the tension of the material between adjacent mill stands of a continuous rolling mill for producing wires, rods, shaped steel stocks, etc.

According to a prior art method of measuring and controlling the tension of the material between adjacent mill stands, a looper is installed between mill stands or the length of the loop of the material is measured by contactless means, for example a combination of a light source and a photoelectric cell or an electrostatic capacitance measuring device, and the measured tension or loop length is used to control the speed of a mill driving motor or to vary the roll gap of the mill. However, since it is necessary in these methods to bend the material to form the loop, it is impossible to apply them to situations where the thickness of the material is large or the cross-sectional configuration of the material is complicated.

Another method of speed control of the mill driving motor has been proposed wherein the current of the motor of the first mill stand when the material passes therethrough (at this time, the tension of the material is zero) is stored and the speed of the motor for driving the first or second mill stand is controlled so that the current of the motor of the first stand becomes equal to said stored current since the material is subjected to a tension or a compression when it is rolled by the first and second mill stands. In this method, instead of using a current value a rolling torque or a predetermined relationship between the rolling torque and the rolling force can also be used. This method, however is not advantageous because a fixed value of the tension is not used. Moreover, in a continuous rolling mill including three or more stands, it is impossible to judge whether the variation in the current or rolling torque or the relationship between the rolling torque and the rolling force is caused by the variation in the tension before or after a given mill stand, so that it is impossible to judge the polarity of the tension control. Further, it is necessary that before an instant at which the current, rolling torque or the relationship between the rolling torque and the rolling force is stored, the tension of the material between the $i$ th stand and the $(i-1)$th stand should have been adjusted to a target value, where $i$ is an integer larger than 1. But if the spacings between stands were too small so that the control interval is short, it would become impossible to control the tension of the stands on the downstream side.

Thus, has been no successful method of maintaining the tension of the material between adjacent stands and it has been impossible to control the tension along the entire length of the material being rolled by a continuous rolling mill.

SUMMARY OF THE INVENTION

Accordingly, it is the principal object of this invention to provide a novel apparatus for controlling the interstand tension of a continuous rolling mill.

To aid the understanding of the principle of this invention, a general theory of a mill will be described briefly. As is well known in the art, the rolling force P and the rolling torque G acting upon the mill rolls are given by the following equations.

$$G = Go - \gamma \cdot t_f + \delta \cdot t_b \quad (1)$$

$$P = Po - \alpha \cdot t_f - \beta \cdot t_b \quad (2)$$

where

Go: the rolling torque under no tension, $t_f$: the forward tension stress $t_b$: the rearward tension stress Po: the rolling force under no tension $\gamma$: the forward tension coefficient and the distribution coefficient of the dimensional deviation to the forward tension $\delta$: the rearward tension coefficient and the distribution coefficient of the dimensional deviation to the rearward tension.

$\alpha,\beta$: constants determined by the rolling program (the dimension of the material, type of the material being rolled, temperature of the material, shape of the rolls and rolling mill.)

Equation (1) means that the driving torque of a given stand is decreased by the forward torque and that it is necessary to increase the driving torque of the stand owing to the rearward tension. Equation (2) means that the rolling force is decreased by either one of the rearward tension and the forward tension.

The first object of this invention is to determine the coefficients $\gamma$ and $\delta$ in equation (1) by utilizing the following equation (3)

$$\gamma = \delta = (A \cdot V/\omega) \cdot K \quad (3)$$

where A represents the cross-sectional area of the material being rolled, V the travelling speed of the material and $\omega$ the angular speed of mill rolls. From equation (3) the coefficients $\gamma$ and $\delta$ can be determined by assuming that the work performed by the tension is equal to the work performed by the rolls when tension is applied to the material. The term A·V is a quantity generally termed a mass flow and this quantity is the same for all stands of a continuous mill. The constants $\alpha$ and $\beta$ in equation (2) can be determined experimentally.

The second object of this invention is to experimentally determine the following equation (4) and to determine the interstand tension stress from equations (1) (2) and (4)

$$Go = A \cdot Po \quad (4)$$

The third object of this invention is to measure and control the interstand tension stress based on respective values determined as above described.

These and further objects of this invention can be accomplished by providing apparatus for measuring and controlling the interstand tension of a continuous rolling mill including a plurality of mill stands driven by individual motors, said apparatus comprising operation apparatus and preset apparatus for presetting a rolling program into the operation apparatus, said operation apparatus including means responsive to a preset value in the preset apparatus for determining a forward tension stress coefficient $\gamma$ and a rearward tension stress coefficient $\delta$ in accordance with an equation $$\gamma = \delta = (A \cdot V/\omega) \cdot K$$

where $\omega$ represents the angular speed of a rolling roll of the rolling mill, K a unit conversion constant, and A·V mass flow.

According to another aspect of this invention there is provided apparatus for measuring and controlling inter-stand tensions of a continuous rolling mill including a plurality of mill stands driven by individual motors, said apparatus comprising rolling force meters provided for respective mill stands; pilot generators driven by the driving motors of respective mill stands; speed regulators responsive to the outputs of respective pilot generators for controlling the speed of respective motors; memory, operation and processing apparatus; a preset device for presetting a predetermined rolling program into said memory, operation and processing apparatus; means for storing the outputs of said pilot generators, the outputs of said rolling force meters and the currents and voltages of respective motors into said memory, operation and processing apparatus, which computes the rolling torque for each mill stand from said voltage, current and speed; computes the rolling torque $G_{iD}$ and the rolling force $P_{iD}$ of the i th stand before the leading end of the material being rolled by the i th stand enters into the $(i+1)$th stand; computes the rolling torque $G'_{iD}$ and the rolling force $P'_{iD}$ of the i th stand when the leading end of the material enters into the $(i+1)$th stand and when the impact drop interval caused thereby has been elapsed; and computes an amount of speed correction $\Delta N_i$ for the $i$ th stand and the amount of speed correction $\Delta N_j$ for the $(i-1)$th stand according to the following equations; and adders connected to the speed regulators for respective motors, the adder of each stand being connected to respond to a predetermined reference speed and an amount of speed correction computed by said memory, operation and processing apparatus for regulating the speed of the motor of the each stand.

$$G_{io} = G_{iD} - \delta_i \cdot t_{i-1}$$

$$P_{io} = P_{iD} + \beta_i \cdot t_{i-1}$$

$$G'_{iD} = G_{io} - \gamma_i \cdot t_i + \delta_i \cdot t_{i-1}$$

$$P'_{iD} = P_{io} - \alpha_i \cdot t_i - \beta_i \cdot t_{i-1}$$

$$G_{io} = A_i \cdot P_{io}$$

$$\Delta N = g_1 (t_i - t_{io})$$

$$\Delta N_j = (\Delta N_i / N_i) N_j [j = 1 \sim (i-1)]$$

where $i$ is an integer larger than 1, $\alpha_i$ and $\beta_i$ are constants representing the distribution coefficient of the dimensional deviation to the forward and rearward tensions respectively between respective stands, $g_i$ represents the gain of each stand, $t_{io}$ the target tension stress, $N_i$ and $N_j$ the present speeds of respective stands and wherein $t_{1-1}$ is taken as zero after the trailing end of the material has passed through the $(i-1)$th stand.

BRIEF DESCRIPTION OF THE DRAWINGS

The invention can be more fully understood from the following detailed descriptions taken in conjunction with the accompanying drawings in which.

DESCRIPTION OF THE PREFERRED EMBODIMENT

Figure 1:
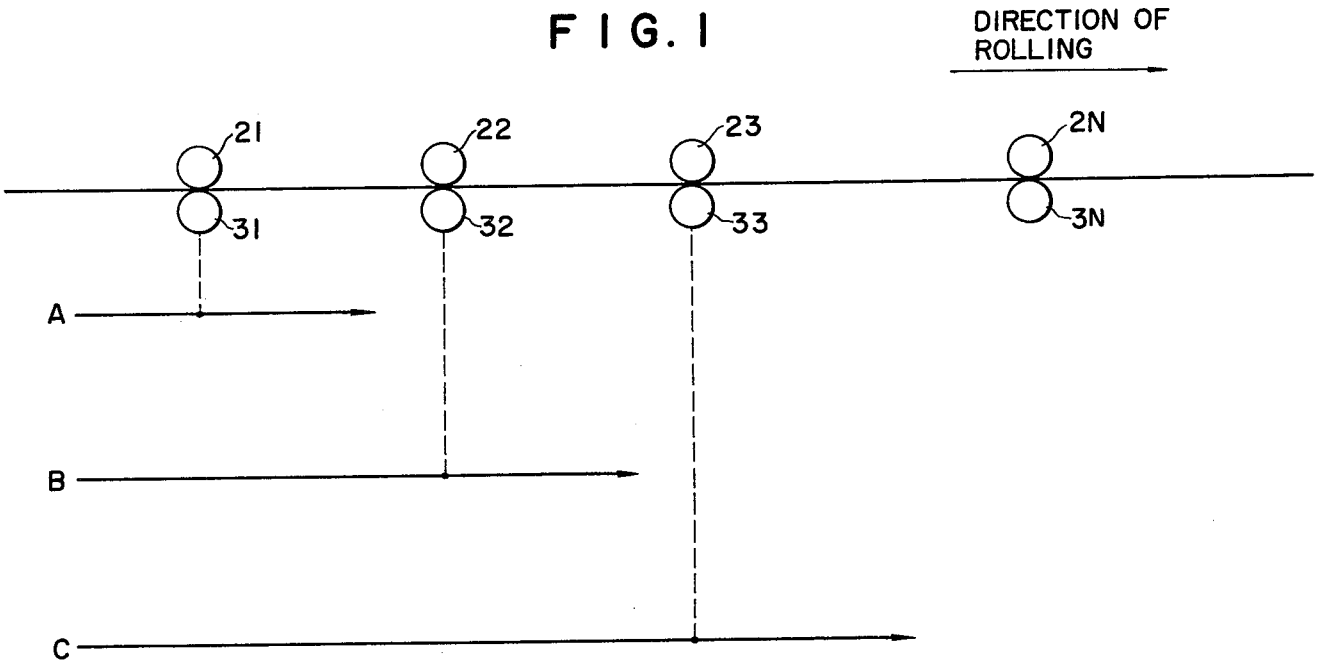
FIG. 1 is a diagrammatic representation of a material travelling through respective stands of a continuous rolling mill.

FIG. 1 is a diagrammatic representation of a continuous rolling mill including a plurality of mill stands from the first to the Nth stand, in which mill rolls of respective stands are designated by 21–31, 22–32, 23–33 and 2N–3N. The speeds of these rolls are controlled by controlling the speeds of their driving motors, not shown.

In FIG. 1, denoting the target tension stress between the first stand and $(i+1)$th stand ($i$ is larger than 1) by $t_{io}$ and the measured value of the tension stress by $t_i$, then the material is rolled under a no tension condition when the target tension stress $t_{io}$ is zero at respective stands. Normally, the rearward tension of the first stand and the forward tension of the Nth stand are zero. Under condition A shown in FIG. 1, the material is rolled only by the first stand so that there is no tension applied to the material. When the leading edge of the material reaches the nip of the rolls and after the impact drop interval of about 0.2 to 0.4 sec. of the roll driving motor caused by the impact has elasped, the motor torque and the rolling force of the first stand are measured and stored in a memory device.

To simplify the description, the gear ratio of the rolls and the driving motors thereof of respective stands is assumed to be unity, that is it is assumed that the rolls are directly coupled with the driving motors, then the motor torque and the rolling torque can be expressed by the following equation $$G = k_1 \cdot \frac{V - IR}{N} \cdot I - k_2 \cdot \frac{dN}{dt} - (k_3 \cdot N + k_4) \quad (5)$$

where

V: the armature voltage of the driving motor
I: the armature current
N: the number of revolutions
R: the armature resistance
$k_1 \sim k_4$: constants.

The first term of the righthand side of equation (5) shows the motor output torque, the second term the acceleration/deceleration torque and the third term the loss torque. For this reason, where V, I and N are measured the rolling torque G can be determined according to equation (5).

Let us denote the no tension torque of the first stand by $G_{10}^{T10}$ and the no tension rolling force thereof by $P_{10}^{T10}$ in which upper suffix $T_{10}$ represents a time, while the lower suffix 10 shows a no tension condition of the first stand. Further, let us denote the no tension torque and the rolling power of the first stand which were measured as described hereinabove by $G_{1D}^{T10}$ and $P_{1D}^{T10}$ respectively in which the suffix 1D represents the measured value of the first stand. Accordingly, $$G_{10}^{T10} = G_{1D}^{T10} \quad (6)$$

$$P_{10}^{T10} = P_{1D}^{T10} \quad (7)$$

Since, by experiment, it has been proven that there is the following relation between $G_{10}^{T10}$ and $P_{10}^{T10}$ $$G_{10}^{T10} = A_1 \cdot P_{10}^{T10} \quad (8)$$

it is possible to determine a constant $A_1$ according to equation (8). At this time, the stored values regarding the first stand are $G_{10}^{T10}$, $P_{10}^{T10}$ and $A_1$.

Under condition B shown in FIG. 1, the material is rolled by both of the first and second mill stands so that the material is subjected to the interstand tension or compression. Assume now that the measured rolling torque and the rolling force of the first stand under these conditions are $G_{1D}^{T11}$ and $P_{1D}^{T11}$ respectively, since the rearward tension of the first stand is zero the following equations can be derived out from equations (1) and (2).

$$G_{1D}^{T11} = G_{10}^{T11} - \gamma_1 \cdot t_1 \quad (9)$$

$$P_{1D}^{T11} = P_{10}^{T11} - \alpha_1 \cdot t_1 \quad (10)$$

where $G_{10}^{T11}$ and $P_{10}^{T11}$ represents no tension torque and the no tension rolling force at time $T_{11}$ of the first stand.

As has been described above, since it has been determined by experiment that there is a proportional relationship between $G_{10}^{T11}$ and $P_{10}^{T11}$ the following equation (11) can be obtained in the same manner as equation (8)

$$G_{10}^{T11} = A_1 \cdot P_{10}^{T11} \quad (11)$$

The tension stress $t_1$ between the first and second stands can be derived out from equations (9) (10) and (11)

$$t_1 = \frac{A_1 \cdot P_{1D}^{T11} - G_{1D}^{T11}}{\tau_1 - \alpha_1 \cdot A_1} \quad (12)$$

Accordingly, to obtain the target tension stress $t_{10}$ between the first and second stands a speed correction quantity $\Delta N_1$ should be applied to the first stand, which is determined by the following equation $$\Delta N_1 = g_1 \cdot (t_1 - t_{10}) \quad (13)$$

where $g_1$ is a constant representing the control gain.

Since $t_1$ determined by equation (12) is the measured value of the interstand tension stress between the first and second stands this value can be used as the measured tension. Under the condition B shown in FIG. 1, the rolling torque $G_{2DT}^{20}$ and the rolling force $P_{2D}^{T20}$ of the second stand are measured where the upper suffix $T_{20}$ represents a time which may be any instant during the interval between the entrance of the material into the nip of the rolls of the first stand and an instant immediately prior to the entrance of the material into the nip of the rolls of the third stand. Since the forward tension of the second stand is zero, the following equations hold.

$$G_{2D}^{T20} = G_{20}^{T20} + \delta_2 \cdot t_1 \quad (14)$$

$$P_{2D}^{T20} = P_{20}^{T20} - \beta_2 \cdot t_1 \quad (15)$$

where $t_1$ is determined by equation 12, and the no tension torque $G_{20}^{T20}$ and no tension rolling force $P_{20}^{T20}$ of the second stand are determined by the following equations $$G_{20}^{T20} = G_{2D}^{T20} - \delta_2 \cdot t_1 \quad (16)$$

$$P_{2D}^{T20} = P_{2D}^{T20} + \beta_2 \cdot t_1 \quad (17)$$

In the same manner as in the first stand it is possible to determine the constant $A_2$ by the following equation $$G_{20}^{T20} = A_2 \cdot P_{20}^{T20} \quad (18)$$

The values of the second stand to be stored are $G_{20}^{T20}$, $P_{20}^{T20}$ and $A_2$.

Under the condition C shown in FIG. 1, the material is rolled by the first, second and third stands. Under this condition, the rolling torque $G_{2D}^{T21}$ and rolling force $P_{2D}^{T21}$ of the second stand are measured. From equations (1) and (2) we obtain $$G_{2D}^{T21} = G_{20}^{T21} - \gamma_2 \cdot t_2 + \delta_2 \cdot t_1 \quad (19)$$

$$P_{2D}^{T21} = P_{20}^{T21} - \alpha_2 \cdot t_2 - \beta_2 \cdot t_1 \quad (20)$$

At time $T_{21}$, the following relationship holds between the no tension torque $G_{20}^{T21}$ and the rolling force $P_{20}^{T21}$.

$$G_{20}^{T21} = A_2 \cdot P_{20}^{T21} \quad (21)$$

Since $t_1$ is determined by equation 12, the measured value of the interstand tension stress between the second and third stands can be determined according to the following equation (22) from equations (19) (20) and (21).

$$t_2 = \frac{A_2(P_{2D}^{T21} + \beta_2 \cdot t_1) - (G_{2D}^{T21} - \delta_2 \cdot t_1)}{\gamma_2 - \alpha_2 A_2} \quad (22)$$

Since the target tension stress between the second and third stands is $t_{20}$ the speed correction quantity $\Delta N_2$ for the second stand to obtain this target value can be determined as follows.

$$\Delta N_2 = g_2 (t_2 - t_{20}) \quad (23)$$

where $g_2$ represents the control gain of the second stand. In order to keep the interstand tension between the first and second stands at a constant value when the speed of the second stand is varied the following secondary correction amount or successive is applied to the first stand $$N_1 = (\Delta N_2 / N_2) \cdot N_1 \quad (24)$$

Summarizing the above, at any instant $T_{io}$ immediately prior to an instant at which the leading end of the material enters into the $(i+1)$th stand the rolling torque $G_{iD}^{Tio}$ and the rolling power $P_{iD}^{Tio}$ of the i th stand are measured.

From equations (1) and (2) we obtain $$G_{iD}^{Tio} = G_{io}^{Tio} + \delta_i t_{i-1} \quad (25)$$

$$P_{iD}^{Tio} = P_{io}^{Tio} - \beta_i t_{i-1} \quad (26)$$

Since the value of $t_{i-1}$ has been determined by the $(i-1)$th stand the no tension torque $G_{io}^{Tio}$ and the rolling force of the $i$ th stand are expressed by the following equations $$G_{io}^{Tio} = G_{iD}^{Tio} - \delta i \cdot t_{i-1} \quad (27)$$

$$P_{io}^{Tio} = P_{iD}^{Tio} + \beta_i t_{i-1} \quad (28)$$

Accordingly, the constant Ai can be determined by the following equation.

$$G_{io}^{Tio} = Ai \cdot P_{io}^{Tio} \quad (29)$$

With regard to the i th stand, $G_{io}^{Tio}$, $P_{io}^{Tio}$ and Ai are stored in a memory device.

After the leading end of the material has entered into the $(i+1)$th stand, the rolling torque $G_{iD}^{Til}$ and the rolling force of the $i$ th stand are measured and by using the following equations (30) and (31) derived from equations (1) and (2) and the following equation (32), the measured value $t_1$ of the tension stress between the $i$ th and $(i+1)$ the stands can be determined by the following euqation (33)

$$G_{iD}^{Til} = G_{io}^{Til} - \gamma_i \cdot t_i + \delta_i \cdot t_{i-1} \quad (30)$$

$$P_{iD}^{Til} = P_{io}^{Til} - \alpha_i t_i - \beta_i t_{i-1} \quad (31)$$

$$G_{io}^{Til} = Ai \cdot P_{io}^{Til} \quad (32)$$

$$t_1 = \frac{Ai(P_{iD}^{Til} + \beta i \cdot t_{i-1}) - (G_{iD}^{Til} - \delta_i \cdot t_{i-1})}{\gamma_i - \alpha_i \cdot Ai} \quad (33)$$

where $t_{i-1}$ represents the measured value of the tension stress between the $(i - 1)$th stand and the i th stand which has been measured at the preceding stand.

Since the target value of the tension stress between the $i$ th and $(i + 1)$th stands is $t_{io}$ the amount of speed correction $\Delta Ni$ of the i th stand for obtaining this value is determined by $$\Delta N_i = g_i(t_i - t_{io}) \quad (34)$$

At this time, the following successive is added to each of the first to $(i - 1)$th stands $$\Delta N_j = (\Delta N_i / N_j) \cdot N_j (j = 1 \sim i - 1) \quad (35)$$

In this manner, measurement and control of the tension stress between respective stands of a continuous rolling mill can be made. However, as the last or Nth stand is a master stand, the speed thereof is not controlled.

Figure 2:
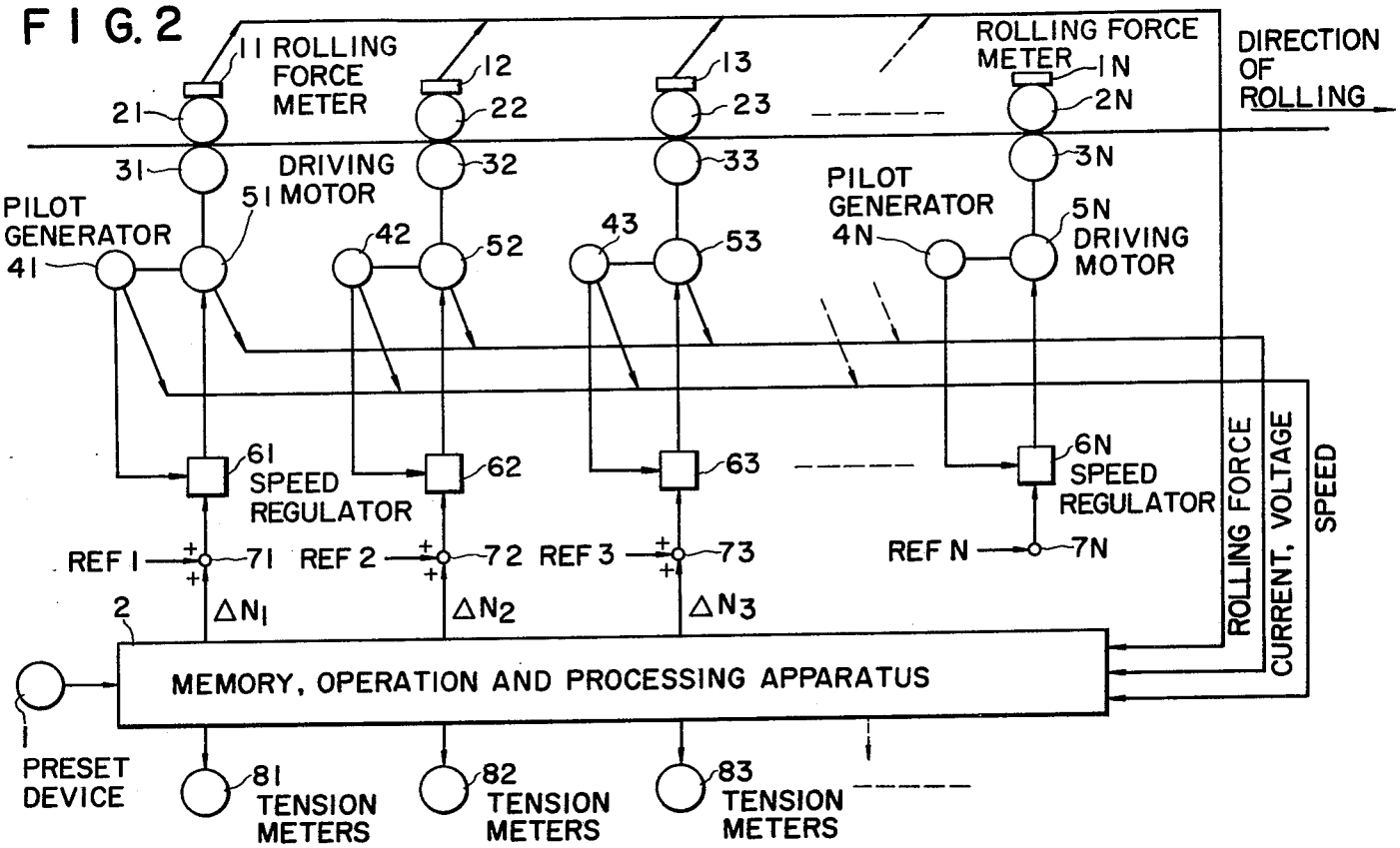
FIG. 2 is a block diagram showing one embodiment of this invention.

One example of the measuring and controlling apparatus of this invention for the interstand stress of a continuous rolling mill will now be described with reference to FIG. 2.

As above described 21 - 2N and 31 - 3N show the rolls of respective stands and the material is inserted into the nip between the rolls 21 and 31 of the first stand and thereafter successively passed through the stands. There are provided rolling force meters 11 - 1N for respective stands, driving motors 51 - 5N for respective stands, pilot generators 41 - 4N, speed regulators 61 - 6N, speed command signals $REF_1$ - REFN, adders 71 - 7N for adding the speed command signal and the amount of speed correction respectively, and tension meters 81, 82 - - 8(N−1) for indicating the measured values of the tension. A preset device 1 for presetting the rolling program of the continuous rolling mill (roll speeds of respective stands, the dimension of the material, the target values of the interstand tensions etc.) and the roll dimension into a memory, operation and processing apparatus 2 to determine a mass flow. The speeds of respective stands are written in the memory, operation and processing apparatus 2 by pilot generators 41, 42 - - 4N and the apparatus 2 calculates the angular speed of the roll $\omega$. Based on the calculated angular speed $\omega$ and the mass flow the $\gamma$ and $\delta$ of respective stands are determined in accordance with equation (3). The values of $\alpha$ and $\beta$ of each stand are determined experimentally and stored in the memory, operation and processing apparatus 2.

At ant time prior to an instant at which the leading end of the material reaches the second stand the values of the voltage, current and speed of the first stand are written in the memory, operation and processing apparatus 2 to calculate the rolling torque $G_{1D}^{T10}$ according to equation (5). At the same time, the rolling force $P_{1D}^{T10}$ of the first stand is written and stored in apparatus 2 through rolling force meter 11 and the constant $A_1$ in equation 8 is determined in accordance with equations (6) and (7), whereby $G_{10}^{T10}$, $P_{10}^{T10}$ and $A_1$ are stored in the apparatus 2.

Then, during an interval between an instant at which the leading end of the material enters into the nip between the rolls 22 and 32 of the second stand and an instant at which the trailing end of the material leaves the first stand and the impact drop interval of the second stand has elapsed, the values of the voltage, current and speed of the first stand are written in the memory, operation and processing apparatus 2 thus calculating the rolling torque $G_{1D}^{T11}$ according to equation (5). At the same time, the rolling force $P_{1D}^{T11}$ of the first stand is also written and stored in the apparatus 2. The time $T_{11}$ represents a continuous or a predetermined sampling interval during an interval between the instant at which the leading end of the material enters into the second stand and the instant at which the trailing end leaves the first stand. The memory, operation and processing apparatus 2 calculates the tension stress $t_1$ between the first and second stands expressed by equation (12) in accordance with these values and equations (10) and (11). The tension stress $t_1$ is displayed by the tension meter 81 of the first stand. The memory, operation and processing apparatus 2 calculates an amount of speed correction $\Delta N_1$ which is necessary to control the tension stress $t_1$ between the first and second stands so as to coincide it with its target value $t_{10}$ in accordance with equation 13, and applies its output to an adder 71.

At time $T_{20}$, the values of the voltage, current and speed of the second stand are written in the memory, operation and processing apparatus 2 so as to calculate the rolling torque $G_{2D}^{T20}$ of the second stand in accordance with equation (5). At the same time, the rolling force $P_{2D}^{T20}$ of the second stand is written into the apparatus 2 through the rolling force meter 12. As above described, since the tension stress $t_1$ between the first and second stands has already been determined, the apparatus 2 caculates $G_{20}^{T20}$, $P_{20}^{T20}$ and $A_2$ according to equations (16) (17) and (18) and stores therein the calculated values.

After the leading end of the material has entered into the nip between the rolls 23 and 33 of the third stand and when the impact drop interval has been elapsed, the values of the voltage, current and speed of the second stands are written into the memory, operation and processing apparatus 2 for causing it to calculate the rolling torque $G_{2D}^{T21}$ of the second stand. At the same time the rolling force $P_{2D}^{T21}$ of the second stand is written in the apparatus 2 for causing it to calculate the tension stress $t_2$ between the second and the third stands and to display the calculated value of $t_2$ by the tension meter 82. Further, the memory, operation and processing apparatus 2 calculates according to equation (23) an amount of speed correction $\Delta N_2$ which is necessary to coincide the tension stress $t_2$ between the second and third stands with its target value $t_{20}$ and applies its output to an adder 72. At the same time, the apparatus 2 applies a successive $\Delta N'_1$ determined by equation (24) to adder 71 associated with the first stand. In equation 24, $N_1$ and $N_2$ represent the present speeds of the first and second stands respectively. In the control for the second stand to (N−1)th stand, since the interstand tension stress is zero at the time when the trailing end of the material leaves the mill, it is necessary to process the tension stress between a stand from which the trailing end leaves and the next stand to be equal to zero.

Considering this condition with regard to the i th stand of a continuous rolling mill including N stands, the values of the voltage, current and speed of the i th stand are written into the memory, operation and processing apparatus 2 during an interval between an instant at which the leading end of the material enters into the i th stand and an instant immediately prior to an instant at which the leading end of the material reaches the $(i+1)$th stand. In response to these data the memory, operation and processing apparatus 2 determines the rolling torque according to equation (5) and at the same time the rolling force of the i th stand is written into the apparatus from the rolling force meter 1*i*. The rolling torque and the rolling force at this time is designated by $G_{iD}^{Tio}$ and $P_{iD}^{Tio}$, respectively. Since the tension stress $t_{i-1}$ between the $(i-1)$ stand and the i th stand has alrady been determined at the $(i-1)$th stand the memory, operaton and processing apparatus 2 determines the no tention torque $G_{iD}^{Tio}$ and the no tension rolling force $P_{io}^{Tio}$ of the *i* th stand according to equations (27) and (28), respectivey and the constant Ai according to equation 29, and stores therein these values $G_{io}^{Tio}$, $P_{io}^{Tio}$ and Ai.

After the leading end of the material has entered into the $(i+1)$th stand, the memory, operation and processing apparatus 2 determines the rolling torque $G_{iD}^{Til}$ from the voltage, current and speed of the il i th stand. At the same time, the rolling force $P_{iD}^{Til}$ is written into the apparatus so that it operates equations (30) (31) (32) and (33) thereby determining the tension stress $t_i$ between the *i* th and $(i+1)$th stands. The value is displayed by a tension meter 8*i*. When the trailing end of the material leaves the $(i-1)$th stand, $t_{1-1}=0$.

The memory, operation and processing apparatus calculates the amount of speed correction ΔNi of the i th stand according to equation 34, which is applied to an adder $7_i$ for controlling the tension stress $t_i$ between the *i* th stand and the $(i+1)$ stand to become equal to its target value. At the same time, the successive determined by equation (35) is added to respective speed references of the first to $(i-1)$th stands so as to prevent the control of the i th stand from affecting the other stands.

As above described, according to the novel apparatus for measuring and controlling the interstand tension of a continuous rolling mill, the interstand tension stress is measured and it is controlled to match with a preset target value.

Accordingly, this invention makes it possible to measure and control the interstand tension stress of a hot strip tandem rolling mill, a medium size shaped steel stock continuous rolling mill or a continuous rolling mill for wire or rod in which the measurement and control of the interstand tension stress have been impossible because it is impossible or extremely difficult to form a loop of the material necessary to measure the interstand tension. Of course, the invention is applicable to cold continuous mills. By the application of this invention it is not only possible to improve the dimentional accuracy of the rolled product but also can stabilize the operation at the time of changing rolls or rolling program. In addition, it is possible to prevent mis-rolling caused by an eroneous setting of the roll speed.

Although in the foregoing description, the interstand tension stress between the *i* th and $(i+1)$th stands was measured at the i th stand, and the speed of the i th stand was corrected so as to coincide the tension stress with its target value, such speed correction can also be made at $(i+1)$th stand. Where the temperature and dimension of the material are uniform throughout its length, the measurement and control are effected by taking a zero rolling force.

I claim:

1. Apparatus for measuring and controlling the interstand tension of a continuous rolling mill including a plurality of mill stands driven by individual motors, said apparatus comprising operation apparatus and preset apparatus for presetting a rolling program into said operation apparatus, said operation apparatus including means responsive to a preset value in said preset apparatus for determining a forward tension stress coefficient $\gamma$ and a rearward tension stress coefficient $\delta$ in accordance with an equation $$\gamma = \delta = A \cdot V/\omega \cdot K$$

where $\omega$represents the angular speed of a rolling roll of said rolling mill, K a unit conversion coefficient, and A·V is mass flow of the rolled material.

2. The apparatus according to claim 1 which further comprises means for causing said operation apparatus to compute rolling torques of respective stands in response to the voltage, current and speed of the driving motors of respective stands, and rolling force meters for measuring the rolling forces of respective stands, and said operation apparatus comprises means to compute the rolling torque $G_{iD}$ from measurements of said voltage, current and speed of said driving motors and measure the rolling force $P_{iD}$ of the i th stand, where *i* is an integer larger than 1, during an interval between the rolling of a material by the *i* th stand and an instant prior to the entering of the leading end of the material into the $(i+1)$th stand, and means for computing the rolling torque $G_{io}$, the rolling force $P_{io}$ and a constant $A_{io}$ under a no tension condition according to the following equations $$G_{io} = G_{iD} - \delta_i \cdot t_{i-1}$$

$$P_{io} = P_{iD} + \beta_i \cdot t_{i-1}$$

$$G_{io} = A_i \cdot P_{io}$$

where $\beta_i$represents a constant representing the distribution coefficient of a dimensional deviation to the rearward interstand tension and $t_{i-1}$ represents the interstand tension stress of the $i-1$th stand previously calculated by said operation apparatus.

3. The apparatus according to claim 2 which further comprises means for causing said operation apparatus to compute the rolling torque $G'_{iD}$ from the voltage, current and speed of the driving motor and measure the rolling force $P'_{iD}$ of the *i* th stand when the leading end of the material enters into the $(i+1)$th stand and the impact drop interval caused thereby has elapsed, and means for computing the interstand tension stress $t_i$ of the *i* th stand according to the equation:

$$t_i = \frac{A_i(P'_{iD} + \beta_i \cdot t_{i-1}) - (G'_{iD} - \delta_i \cdot t_{i-1})}{\gamma_i - \alpha_i \cdot A_i}$$

which is derived from the equations:

$$G_{io} = G_{iD} - \delta_i \cdot t_{1-1}$$

$$P_{io} = P_{iD} + \beta_i \cdot t_{i-1}$$

$$G_{io} = A_i \cdot P_{ip}$$

$$G'_{iD} = G_{io} - \gamma_i \cdot t_i + \delta_i \cdot t_{i-1}$$

$$P'_{iD} = P_{io} - \alpha_i \cdot t_i - \beta_i \cdot t_{i-1\,\beta}$$

where $\alpha_1$ and $\beta_1$ are constants representing the distribution coefficient of the dimensional deviations to the forward and rearward interstand tensions, respectively, and wherein $t_{i-1}$ is the tension stress calculated for the $i-1$ th stand which is taken as zero after the trailing end of the material has passed through the $(i-1)$th stand.

4. The apparatus according to claim 1 which further comprises means for causing said operation apparatus to compute the rolling torques of respective stands responsive to the voltage, current and speed of the driving motors of respective stands rolling force meters for measuring the rolling forces of respective stands, and target tension setters for setting the target tension stresses of respective stands, and wherein said operation apparatus comprises means for computing the rolling torque $G_{iD}$ from said voltage, current and speed of the driving motors and measuring the rolling force $P_{iD}$ of the i th stand before the leading end of the material being rolled by the $i$ th stand enters into the $(i+1)$th stand, means for calculating a desired rolling torque $G_{io}$ and rolling power $P_{io}$ in accordance with the equations:

$$G_{io} = G_{iD} - \delta_i \cdot t_{i-1}$$

$$P_{io} = P_{iD} + \beta_i \cdot t_{i-1}$$

means for computing the rolling torque $G'_{iD}$ from the voltage, current and speed of the driving motor and measuring the rolling force $P'_{iD}$ of the $i$ th stand when the leading end of the material enters into the $(i+1)$th stand and when the impact drop interval caused thereby has been elapsed, means for computing an interstand tension stress $t_i$ of the $i$ th stand from the equation:

$$t_i = \frac{A_i(P'_{iD} + \beta_i \cdot t_{i-1}) - (G'_{iD} - \delta_i \cdot t_{i-1})}{\gamma_i - \alpha_i \cdot A_i}$$

which is derived from the equations:

$$G_{io} = G_{iD} - \delta_i \cdot t_{i-1}$$

$$P_{io} = P_{iD} + \beta_i \cdot t_{i-1}$$

$$G_{io} = A_i \cdot P_{io}$$

$$G'_{iD} = G_{io} - \gamma_i \cdot t_i + \delta_i \cdot t_{i-1}$$

$$P'_{iD} = P_{io} - \alpha_i \cdot t_i - \beta_i \cdot t_{i-1}$$

means for computing the amount of speed correction $\Delta N_i$ needed for the $i$ th stand according to the equation:

$$\Delta N_i = g_i(t_i - t_{io})$$

means for applying the computed $\Delta N_i$ to the target tension setter of the $i$ th stand, means for simultaneously computing the successive amounts of correction $\Delta N_j$ needed for the first to the $(i-1)$th stands according to the equation:

$$\Delta N_j = (\Delta N_i/N_i) \cdot N_j [j = 1 \sim (i-1)] \text{ and}$$

means for applying respective correction amounts $\Delta N_j$ to the target tension setters of from the first to $(i-1)$th stands, where $\alpha_i$ and $\beta_i$ are constants representing the distribution coefficient of the dimensional deviation to the forward and rearward tensions, respectively, between respective stands, $g_i$ represents the gain of each stand, $t_{io}$ the target tension stress, $N_i$ and $N_j$ the present speeds of respective stands, and wherein $t_{i-1}$ is the tension stress calculated for the $(i-1)$th stand which is taken as zero after the trailing end of the material has passed through the $(i-1)$th stand.

5. Apparatus for measuring and controlling interstand tensions of a continuous rolling mill including a plurality of mill stands driven by individual motors, said apparatus comprising rolling force meters provided for respective mill stands; pilot generators driven by the driving motors of respective mill stands; speed regulators responsive to the outputs of respective pilot generators for controlling the speed of respective motors; memory operation and processing apparatus; a preset device for presetting a predetermined rolling program into said memory, operation and processing apparatus; means for storing the outputs of said pilot generators, the outputs of said rolling power meters and the currents and voltages of respective motors into said memory, operation and processing apparatus, which computes the rolling torque $G_{iD}$ for each mill stand from said voltage, current and speed of said stand motors, and measures the rolling force $P_{iD}$ of the $i$ th stand before the leading end of the material being rolled by the $i$ th stand enters into the $(i+1)$th stand, computes a rolling torque $G_{io}$ and rolling force $P_{io}$ according to the equations:

$$G_{io} = G_{iD} - \delta_i \cdot t_{i-1}$$

$$P_{io} = P_{iD} + \beta_i \cdot t_{i-1}$$

computes a rolling torque $G'_{iD}$ from the voltage, current and speed of each of the i th mill stand motors and measures the rolling power $P'_{iD}$ of the $i$ th stand when the leading end of the material enters into the $(i+1)$th stand and when the impact drop interval caused thereby has elapsed; computes an interstand tension stress $t_i$ from the equations:

$$G'_{iD} = G_{io} - \gamma_i \cdot t_i + \delta_i \cdot t_{i-1}$$

$$P'_{iD} = P_{io} - \alpha_i \cdot t_i - \beta_i \cdot t_{i-1}$$

$$G_{io} = A_i \cdot P_{io}$$

and computes an amount of speed correction $\Delta N_i$ for the $i$ th stand and the amount of speed correction $\Delta N_j$ for the first to the $(i-1)$th stands according to the equations:

$$\Delta N_i = g_1(t_1 - t_{io})$$

$$\Delta N_j = (\Delta N_i/N_i)N_j [j - 1 \sim (i-1)]$$

and adders connected to the speed regulators for respective motors, the adder of each stand being connected to respond to a predetermined reference speed and an amount of speed correction computed by said memory, operation and processing apparatus for regulating the speed of the motor of the each stand, where $i$ is an integer larger than 1, $\alpha_i$ and $\beta_i$ are constants representing the distribution coefficient of the dimensional deviation to the forward and rearward tensions respectively between respective stands, $g_i$ represents the gain of each stand, $t_{io}$ the target tension stress, $N_i$ and $N_j$ the present speeds of respective stand motors and $t_{i-1}$ is the tension stress calculated for the $i - 1$ th stand which is taken as zero after the trailing end of the material has passed through the $(i - 1)$th stand.

* * * * *